United States Patent [19]

Ruhle

[11] Patent Number: 4,492,143

[45] Date of Patent: Jan. 8, 1985

[54] ANTI-ROTATION MASS SUPPORT SYSTEM PARTICULARLY FOR MISSILE SUPPORT

[75] Inventor: Philip G. Ruhle, Los Gatos, Calif.

[73] Assignee: Westinghouse Electric Corp., Pittsburgh, Pa.

[21] Appl. No.: 499,629

[22] Filed: May 31, 1983

[51] Int. Cl.[3] ..... F41F 3/04

[52] U.S. Cl. ..... 89/1.816; 89/1.810; 248/632; 267/140.1

[58] Field of Search ..... 89/1.816, 1.819, 1.809, 89/1.810, 1.8, 1.815; 248/638, 632, 634, 619, 562; 267/140.1

[56] References Cited

U.S. PATENT DOCUMENTS

| | | | |
|---|---|---|---|
| 2,572,919 | 10/1951 | French et al. | 248/619 X |
| 2,876,979 | 3/1959 | Barbara | 267/140.1 |
| 2,878,012 | 3/1959 | Crites | 248/619 X |
| 2,919,883 | 1/1960 | Murphy | 267/140.1 |
| 3,072,022 | 1/1963 | Wood et al. | 89/1.810 X |
| 3,089,389 | 5/1963 | Andrews et al. | 89/1.816 |
| 3,166,978 | 1/1965 | Price et al. | 89/1.816 |
| 3,189,303 | 6/1965 | Boothe | 248/638 X |
| 3,221,602 | 12/1965 | Price et al. | 89/1.816 |
| 3,266,373 | 8/1966 | Brown | 89/1.810 X |
| 3,289,533 | 12/1966 | Brown | 89/1.810 |
| 3,367,235 | 2/1968 | Andrews | 89/1.816 |
| 3,368,452 | 2/1968 | Fredrickson et al. | 89/1.816 |
| 3,392,629 | 7/1968 | Soderberg | 89/1.816 |
| 3,857,321 | 12/1974 | Cohen | 89/1.816 X |
| 4,424,961 | 1/1984 | Takei | 248/632 |

*Primary Examiner*—David H. Brown

*Attorney, Agent, or Firm*—G. H. Telfer

[57] ABSTRACT

An anti-rotational mass support system such as for a missile comprises, in a mechanically parallel configuration, a bellows centrally located under the mass for permitting a degree of axial, tilt and radial motion while providing substantial stiffness against rotational motion and an elastomer shock isolator.

2 Claims, 2 Drawing Figures

ANTI-ROTATION MASS SUPPORT SYSTEM PARTICULARLY FOR MISSILE SUPPORT

GOVERNMENT CONTRACT

The Government has rights in this invention pursuant to Contract No. N00019-81-C-3118 awarded by the Department of the Navy.

BACKGROUND AND SUMMARY OF THE INVENTION

Vertical shock absorber systems for supporting a missile within a launch tube are required to have an axial and radial spring rate, or stiffness, determined by the shock migration requirements imposed on the launcher. Frequently, the shock requirements dictate a relatively soft system, that is, one in which there is some freedom of movement in axial, radial, and tilt directions. At the same time, the support system must maintain rather precise rotational alignment of the missile within the tube, thus requiring substantial stiffness in the direction of rotation about the tube center line.

Mounting systems of pre-loaded liquid springs can provide the desired spring and stiffness characteristics. In missile support systems that include a shock isolator comprised of elastomer pads or rings, as has been used and proposed before, it is a difficult problem to satisfactorily arrange hydraulic support elements and, although they provide some benefit, they do not readily provide the degree of relation between axial flexing and rotational stiffness as is desired. The required rotational stiffness is known to be achievable by a system of linkage arms and spherical bearings. This, however, adds considerable complexity to the system and requires more space within the diameter inside of an elastomer ring shock absorber.

In accordance with the present invention, hydraulic springs and systems including linkage arms and spherical bearings are unnecessary, and simplicity and effectiveness of performance are achieved. Briefly, the invention achieves these purposes by using a metal bellows attached mechanically in parallel with an elastomer shock isolator system to provide the rotational stiffness required. The bellows can be sized readily to have a low spring rate relative to the shock isolator system in the axial and lateral directions, but is relatively stiff in rotation about the axial center line. The different requirements of spring rate are met by using the elastomer shock absorber and the metal bellows in conjunction with each other rather than relying on either element alone. The metal bellows has relatively little shock dampening qualities in axial, radial and tilt directions, but these are functions that can be readily taken care of by known types of elastomer shock absorbers.

In calculated results, it has been shown that as compared with a system of like character using an elastomer shock isolator but without a metal bellows, that the metal bellows increases the system's rotational stiffness by a factor of about 15, but only increases the axial stiffness by about 8 percent.

While the invention is presently intended for application to missile mounting systems, it will be apparent that its utility is not so limited and that the sprung mass may be other than a missile, in accordance with the broader aspects of the present invention.

DESCRIPTION OF THE PREFERRED EMBODIMENTS

Figure 1:
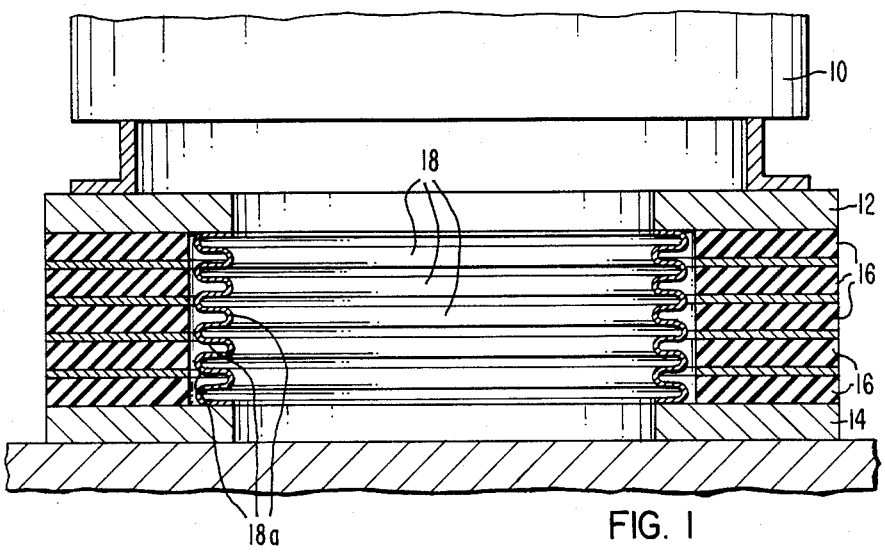
FIG. 1 is a cross-sectional view illustrating an embodiment of the present invention; and, FIG. 2 is a cross-sectional view illustrating a further embodiment of the invention.

Referring to FIG. 1, a sprung mass 10 rests on a support pad 12 that is isolated from a lower, fixed support structure 14 by an elastomer shock isolator comprising, in this instance, a plurality of elastomer rings 16. Interiorly of the elastomer rings is a bellows 18 that is attached at its upper extremity to the support pad 12 and at its lower extremity to the lower support 14 so that it is mechanically in parallel with the elastomer rings 16. The bellows 18 is preferably metal, such as Inconel alloy for stress corrosion resistance, and is configured as a cylindrical tube with circumferential corrugations 18*a*. The corrugations 18*a* of the bellows 18 can be seen to permit flexing of the bellows in response to shocks in the axial direction or those which induce some degree of tilting or radial displacement. These shocks are absorbed by the elastomer rings 16. When subjected to forces tending to induce rotation of the sprung mass 10, the tubular bellows 18 resists such motion and operates as an anti-rotation device much more effectively than the elastomer rings 16.

In missile support systems, a tendency for rotation of the missile may be induced by unsymmetrical loading on support pads on the sides of the missile or when the vehicle, such as a submarine, in which the missile is mounted rolls. Such rotation is adverse to the performance requirements of the missile and, hence, a system in accordance with this invention is highly desirable.

Figure 2:
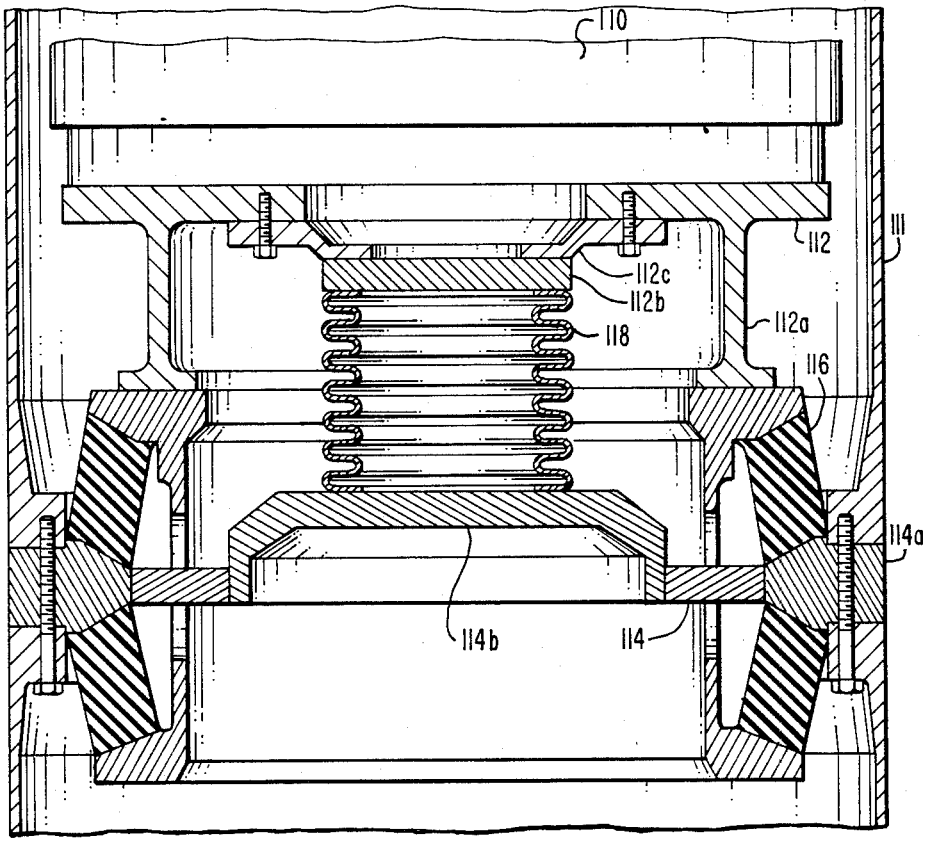

FIG. 2 illustrates an embodiment of the invention particularly for missile mounting. Here, the sprung mass is a missile 110 located within a cylindrical missile launch tube 111 and rests (either by gravity support or by an attachment such as bolting which upon launch is breakable) on a support pad 112. The pad 112 is an annular flat member that has a downwardly depending cylindrical portion 112*a* that is joined with an elastomer shock isolator 116 of a character as has been previously proposed in missile systems. The shock isolator 116 has one or more elastomer shock isolator elements located between support element 112*a* and radially extending members 114 that are affixed by mounting lugs 114*a* to the inner surface of the launch tube 111 and provide the lower, fixed support of the mounting system.

Additionally, in accordance with this invention there is a centrally located metal bellows 118. The upper extremity of the metal bellows 118 is affixed through plate 112*b* and ring 112*c* to the interior portion of the support ring 112. The lower extremity of the metal bellows 118 is affixed through plate 114*a* to the radially extending lower support 114 that also supports the elastomer shock isolator 116. As can be seen, therefore, the metal bellows 118 and the shock isolator 116 are mechanically in parallel in support of the missile 110 thus providing the characteristics desired for permitting the support pad 112 and the mass thereon to move in axial, tilt and radial directions while providing substantial stiffness against rotational movement.

The metal bellows used in embodiments of the invention is sized to have a low spring rate relative to the shock isolator system in the axial and lateral directions.

but is relatively stiff in rotation about the axial center line. The bellows can thus provide the required anti-rotation capability without recourse to a system of linkages, bars and spherical bearings. As is apparent from the Figures shown here, particularly that of FIG. 1, the bellows may be sized in diameter to be close to the inner periphery of the elastomer ring assembly and does not take up space as would be required by a complex linkage assembly.

Metal bellows, or flex joints as they are sometimes called, are known structural elements readily available from a number of manufacturers and here applied in a new manner in conjunction with elastomer shock isolators to provide a combination of qualities not available from either portion of the structure by itself.

In a typical mounting system proposed for practical application, a missile of about 3,200 pounds and about 23 inches in diameter is supported on a configuration as shown in FIG. 2 in a system with a calculated rotational stiffness of $3.28 \times 10^6$ inch-pounds per radian and an axial spring rate of 23,788 pounds per inch. The elastomer shock isolator 116 as shown, if used by itself without the bellows 118, has a rotational stiffness of 233,520 inch-pounds per radian and axial spring rate of 22,000 pounds per inch. Thus, the bellows is expected to increase the system's rotational stiffness by a factor of about 15, but only increases the axial stiffness by about 8 percent.

It will be apparent that while a limited number of embodiments are shown and described, the invention may take various additional forms consistent with the teachings herein.

I claim:

1. An anti-rotation shock absorber system for supporting a missile comprising: a substantially cylindrical launch tube; a substantially circular support pad for the missile disposed within said launch tube; said support pad being joined at an outer portion thereof to an elastomer shock isolator that is joined to said launch tube; said support pad also being joined at an inner portion thereof to an upper end of a metal bellows that is centrally located thereunder and resists rotation while permitting axial, tilt and radial movement; said metal bellows having a lower end joined to said launch tube in a manner to provide said metal bellows mechanically in parallel with said elastomer shock isolator.

2. An anti-rotation shock absorber system in accordance with claim 1 wherein:

said elastomer shock isolator comprises one or more elastomer elements located between said support pad and a lower support member to which said lower end of said metal bellows is joined, said lower support member being joined to said launch tube.

* * * * *